US007036182B2

(12) United States Patent
Bukovitz et al.

(10) Patent No.: US 7,036,182 B2
(45) Date of Patent: May 2, 2006

(54) PAINT ROLLER GRID AND GRID ASSEMBLY

(75) Inventors: Richard K. Bukovitz, Orrville, OH (US); Thomas G. Purdy, Orrville, OH (US)

(73) Assignee: The Wooster Brush Company, Wooster, OH (US)

( * ) Notice: Subject to any disclaimer, the term of this patent is extended or adjusted under 35 U.S.C. 154(b) by 498 days.

(21) Appl. No.: 10/244,310

(22) Filed: Sep. 16, 2002

(65) Prior Publication Data

US 2004/0049876 A1 Mar. 18, 2004

(51) Int. Cl.
*B65D 25/00* (2006.01)

(52) U.S. Cl. ..... 15/257.06; 15/104.92; 15/257.05; 134/135

(58) Field of Classification Search ..... 15/257.06, 15/104.92, 257.05; 134/135; 401/120, 118; 220/695, 702, 570, 700
See application file for complete search history.

(56) References Cited

U.S. PATENT DOCUMENTS

| | | | | |
|---|---|---|---|---|
| 2,659,917 | A | 11/1953 | Drum | |
| 3,110,921 | A | 11/1963 | Conner | |
| 3,112,533 | A * | 12/1963 | Hauer | 52/674 |
| 3,409,931 | A | 11/1968 | Graf | |
| 3,493,988 | A | 2/1970 | Tidwell | |
| 3,940,824 | A | 3/1976 | Gioia et al. | |
| 4,083,466 | A | 4/1978 | McManaway | |
| 4,145,789 | A | 3/1979 | Morgan, Sr. | |
| 4,200,949 | A | 5/1980 | Heniff, Jr. | |
| D264,147 | S | 5/1982 | Heath | |
| 4,756,046 | A | 7/1988 | Surface et al. | |
| 4,865,282 | A | 9/1989 | Yonkman et al. | |
| 5,123,576 | A | 6/1992 | Lawrence | |
| 5,283,928 | A | 2/1994 | Linn et al. | |
| 5,364,491 | A * | 11/1994 | Aochi et al. | 156/446 |
| 5,695,098 | A | 12/1997 | King | |
| 5,727,708 | A | 3/1998 | Erickson | |
| 5,810,196 | A | 9/1998 | Lundy | |
| 5,966,772 | A * | 10/1999 | Woodnorth et al. | 15/230.11 |
| 6,119,303 | A | 9/2000 | Passafiume | |

* cited by examiner

*Primary Examiner*—Richard Crispino
*Assistant Examiner*—Abraham Bahta
(74) *Attorney, Agent, or Firm*—Renner, Otto, Boisselle & Sklar, LLP

(57) ABSTRACT

A paint roller grid includes a wiping surface surrounded by a frame member having a pair of spaced apart hooks connected to the upper edge of the frame member for releasably attaching the grid to a container rim. The hooks may be spaced laterally outwardly from opposite ends of the upper edge of the frame member to provide spaces therebetween for receipt of portions of the upper rim and upper side wall of the container in the spaces. A plurality of spaced apart tabs may be provided along the side edges of the grids for connecting two or more such grids together along their respective side edges to form a paint roller grid assembly comprising two or more such grids.

16 Claims, 8 Drawing Sheets

PAINT ROLLER GRID AND GRID ASSEMBLY

FIELD OF THE INVENTION

This invention relates to a paint roller grid that is adapted to be mounted in a standard five gallon bucket or other container for aiding in dispersing paint (or other liquid) more evenly over paint roller covers. Also two or more of the grids may be connected together along their respective side edges to form a wider grid assembly that may be mounted in a wider container for use in dispersing paint over wider paint roller covers.

BACKGROUND OF THE INVENTION

It is generally known to mount paint roller grids inside a standard five gallon bucket or other container to provide a wiping surface above the level of a quantity of paint in the container for aiding in dispersing the paint more evenly over paint roller covers having a width, for example, of nine inches or less. As used herein, the term paint or paint roller cover means and includes any paint, stain, sealer or other liquid coating that is suitable for application with a roller cover mounted on a roller frame. The grid wiping surfaces typically include a plurality of openings or ridges that aid in dispersing the paint more evenly over the roller covers and allow any excess paint to drain back into the container after the roller covers are immersed in the paint and rolled along the wiping surfaces.

Most paint roller covers have a width of nine inches or less. Accordingly, most paint roller grids have a width slightly greater than that (for example ten inches) so that they may conveniently be inserted into a standard five gallon container. Paint roller covers having a width substantially greater than nine inches (for example eighteen inches) are sometimes used for applying paint to relatively large flat surface areas such as decks, fencing, siding, etc. It would be desirable to be able to adapt a grid used to disperse paint over the smaller width paint roller covers to disperse paint over the larger width paint roller covers as well.

SUMMARY OF THE INVENTION

The paint roller grids of the present invention may be used individually for aiding in dispersing paint more uniformly over paint roller covers having widths less than the width of the individual paint roller grids. Alternatively, two or more such paint roller grids may be connected together along their respective side edges to form a wider grid assembly for aiding in dispersing paint over paint roller covers having widths greater than the width of the individual paint roller grids.

In accordance with one aspect of the invention, a plurality of spaced apart tabs may be provided along connectable side edges of two or more such grids for connecting such grids together along their respective side edges to form a paint roller grid assembly comprising two or more such grids.

In accordance with another aspect of the invention, the tabs may have enlarged outer end portions that are adapted to overlap the enlarged outer end portions of the tabs of another such grid for connecting two such grids together along their respective connectable side edges.

In accordance with another aspect of the invention, at least three such tabs may be provided along the connectable side edges of two or more such grids with the enlarged outer end portions of the respective tabs alternately facing in opposite directions whereby when the oppositely facing enlarged outer end portions of the tabs of two or more such grids are overlapped, the tabs will retain such grids together along their respective connectable side edges.

In accordance with another aspect of the invention, the respective connectable side edges of the grids may have recesses laterally inwardly of the enlarged outer end portions of the respective tabs that are adapted to receive the enlarged outer end portions of the corresponding tabs of another such grid when the enlarged outer end portions of the tabs of two or more such grids are overlapped along their respective connectable side edges.

In accordance with another aspect of the invention, the enlarged outer end portions of the tabs may have laterally inwardly facing shoulders that are adapted to overlap the laterally inwardly facing shoulders of the respective tabs of another such grid for connecting two or more such grids together along their respective connectable side edges.

In accordance with another aspect of the invention, the laterally outermost ends of the enlarged outer end portions of the tabs may have cam surfaces to aid in sliding of the enlarged outer end portions of the tabs of two or more such grids into overlapping engagement with each other when connecting two or more such grids together.

In accordance with another aspect of the invention, the grids may have laterally spaced apart hooks for releasably attaching the grids to the upper rims of different paint containers with the grids extending downwardly and forwardly into the containers at an angle.

In accordance with another aspect of the invention, the grid hooks may have a rearwardly extending upper portion adapted to abut an upper surface of the rim of a standard five gallon container, a downwardly extending forwardly facing curved portion sized to extend around a downturned lip of the rim, and a downwardly and forwardly sloping free end portion sized to overlap a bottom edge of the downturned lip to resist lifting of the hooks off the rim.

In accordance with another aspect of the invention, the downwardly and forwardly sloping free end portion of the hooks terminate in spaced relation from the back side of the grid to provide a clearance space therebetween which is greater than the height of the downturned lip of a wider container to allow the lip to pass through the clearance space when the grid is angled upwardly relative to the container rim and less than the width of the lip to prevent the hooks from being disengaged from the lip when the grid is rotated downwardly about the rim into the container.

In accordance with another aspect of the invention, the grid hooks may be spaced laterally outwardly from opposite ends of the upper edge of the grid to provide spaces therebetween for receipt of portions of the container rim and upper side wall of a standard five gallon container in such spaces.

In accordance with another aspect of the invention, the outermost side edges of the grid hooks may be in substantial vertical alignment with opposite side edges of the grid except at upper ends of the side edges which may have notches therein for receiving portions of the upper rim and upper side wall of a standard five gallon container.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
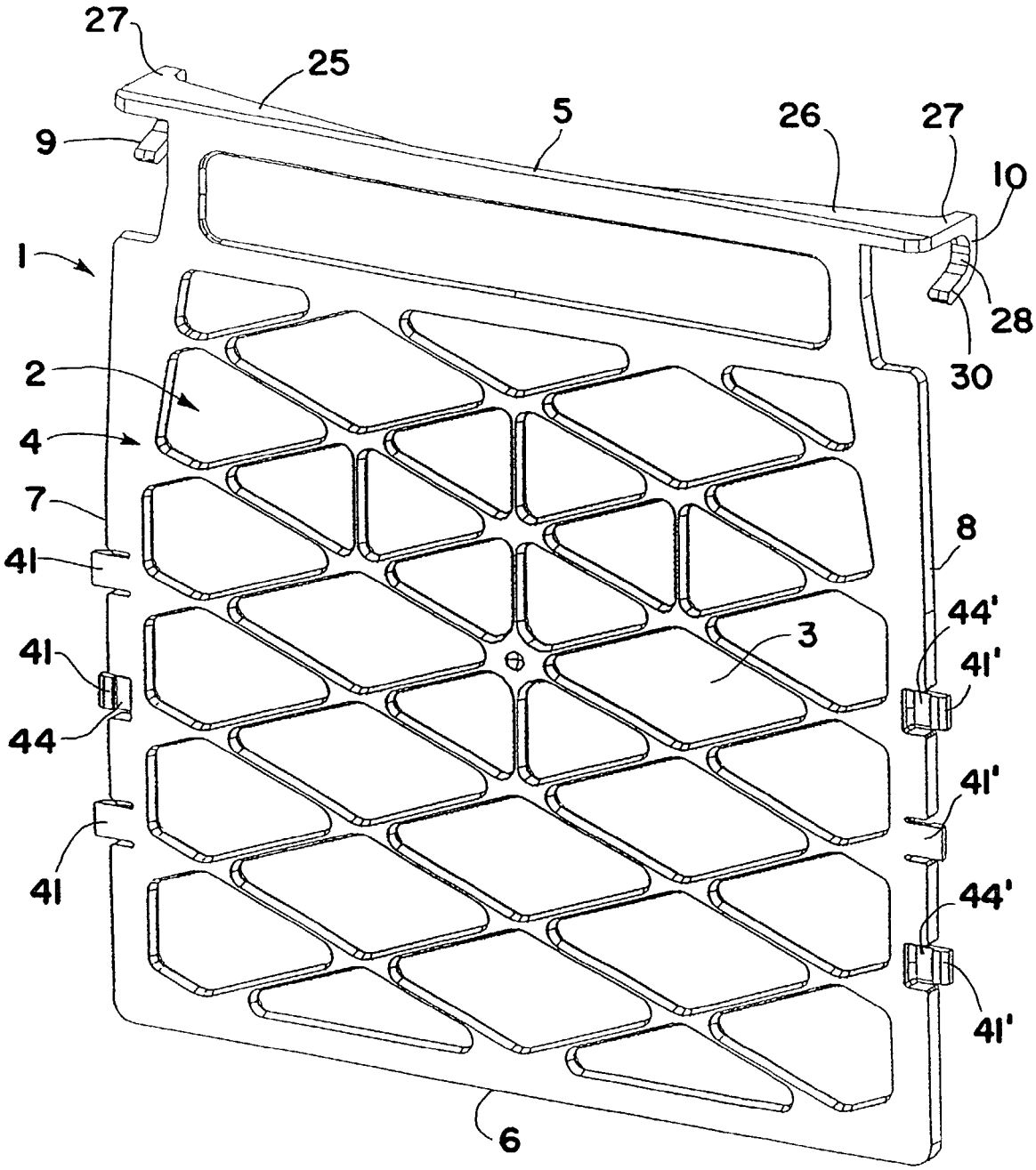
FIG. 1 is a perspective view of one form of paint roller grid in accordance with this invention.
Figure 3:
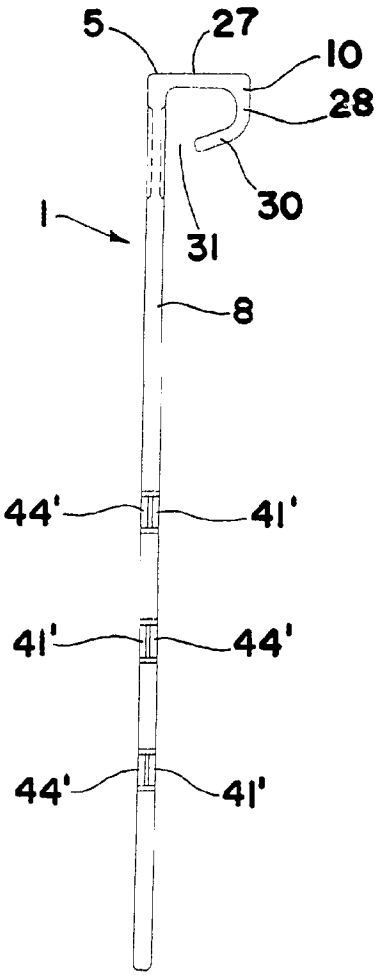
FIG. 3 is a side elevation view of the paint roller grid of FIG. 2 as seen from the right side thereof.
Figure 2:
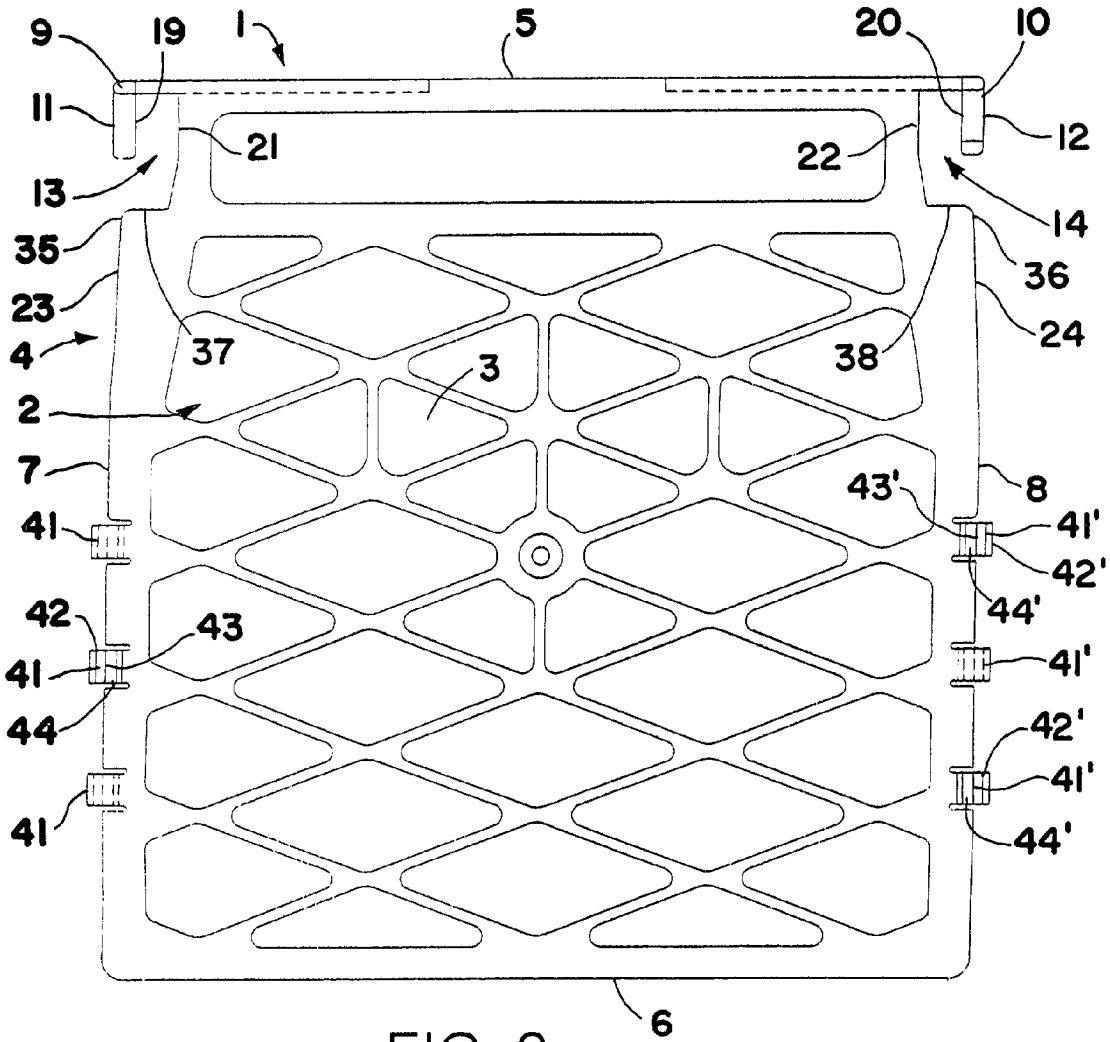
FIG. 2 is a front elevation view of the paint roller grid of FIG. 1.
Figure 4:
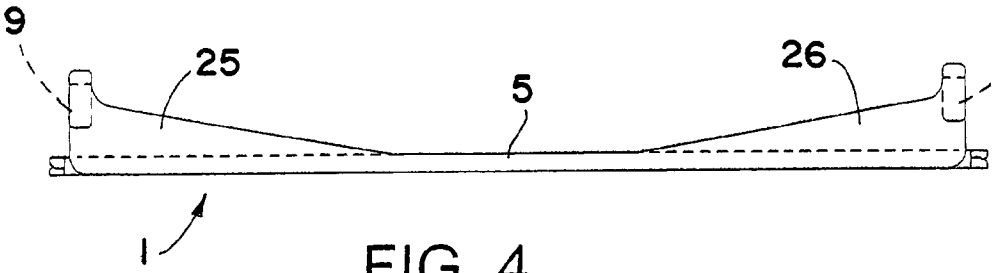
FIG. 4 is a top plan view of the paint roller grid of FIG. 2.
Figure 5:
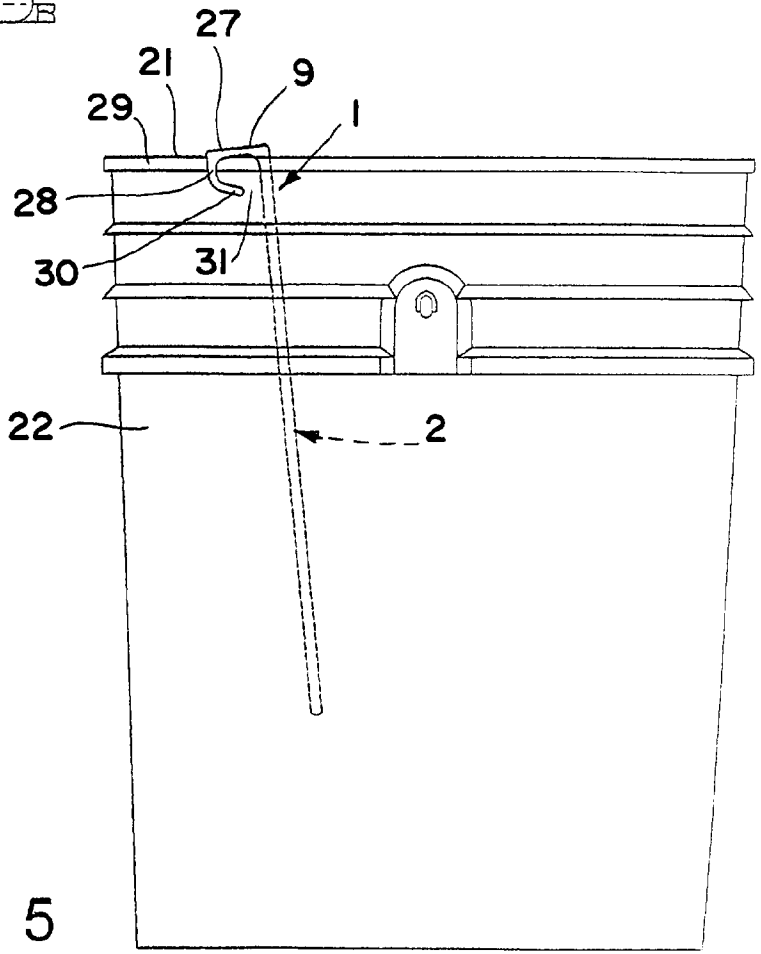
FIG. 5 is a schematic elevation view of a standard five gallon container showing in side elevation the paint roller grid of FIGS. 1–4 extending downwardly and forwardly inside the container at an angle.

Referring now in detail to the drawings, and initially to FIGS. 1–4, there is shown one form of paint roller grid 1 in accordance with this invention which may be integrally molded out of a suitable plastic material. Grid 1 is intended to be mounted, for example, inside a standard five gallon bucket or other container to help disperse paint (or other liquid) more evenly over a paint roller cover after the paint roller cover has been immersed in a supply of paint in the container by rolling the paint roller cover along the wiping surface 2 of the grid. As previously indicated, the term paint or paint roller cover as used herein means and includes any paint, stain, sealer or other liquid coating that is suitable for application with a roller cover mounted on a roller frame.

The grid wiping surface 2 may have a plurality of ridges or openings 3 of any desired shape for aiding in dispersing the paint more evenly over the roller cover and allowing any excess paint to drain back into the container after the roller cover has been immersed in the paint and rolled along the wiping surface, as well known in the art. Surrounding the wiping surface 2 is a frame member 4 that has upper and lower edges 5, 6 and opposite side edges 7, 8. Attached to the upper edge 5 are a pair of spaced apart hooks 9, 10 for suspending the grid within different types of containers as described hereafter.

The outermost side edges 11, 12 of the hooks 9, 10 may be in substantial vertical alignment with the opposite side edges 7, 8 except at the upper ends of the side edges which may have notches 13, 14 extending below and inwardly of the hooks for receiving portions of the upper rim 15 and upper side wall 16 of a standard five gallon container 18 between the innermost side edges 19, 20 of the hooks and opposite sides 21, 22 of the notches as schematically shown in FIGS. 5–7 and 7*a*. The upper portions 23, 24 of the side edges 7, 8 immediately below the notches 13, 14 may have a slight inward taper toward the notches (for example a 2° taper) to allow the paint roller grid to extend downwardly and forwardly into the container 18 at a slight angle when the hooks 9, 10 are snapped over the container rim as described hereafter.

Figure 7:
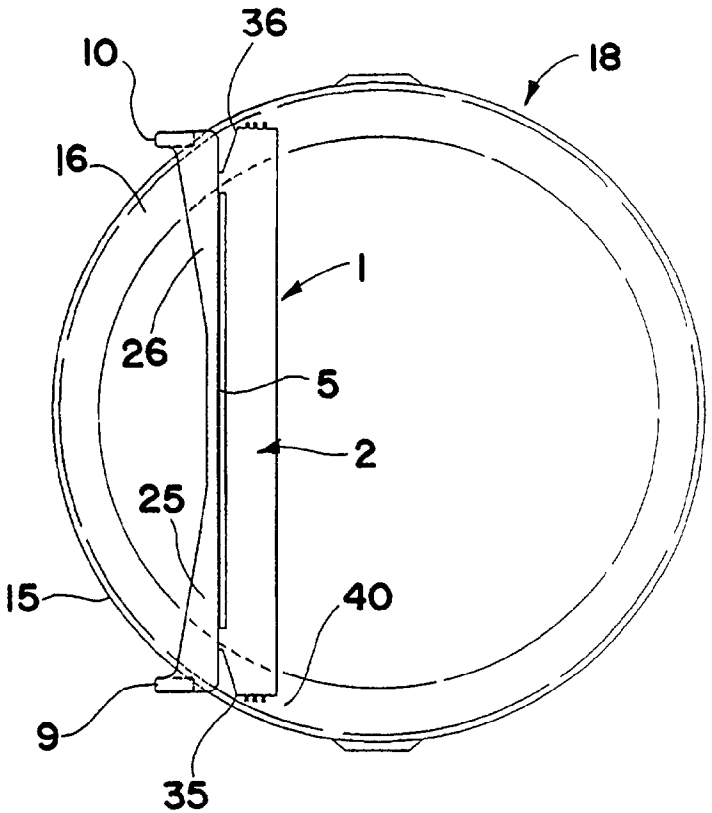
FIG. 7 is a schematic top plan view of the container and paint roller grid of FIG. 5.
Figure 6:
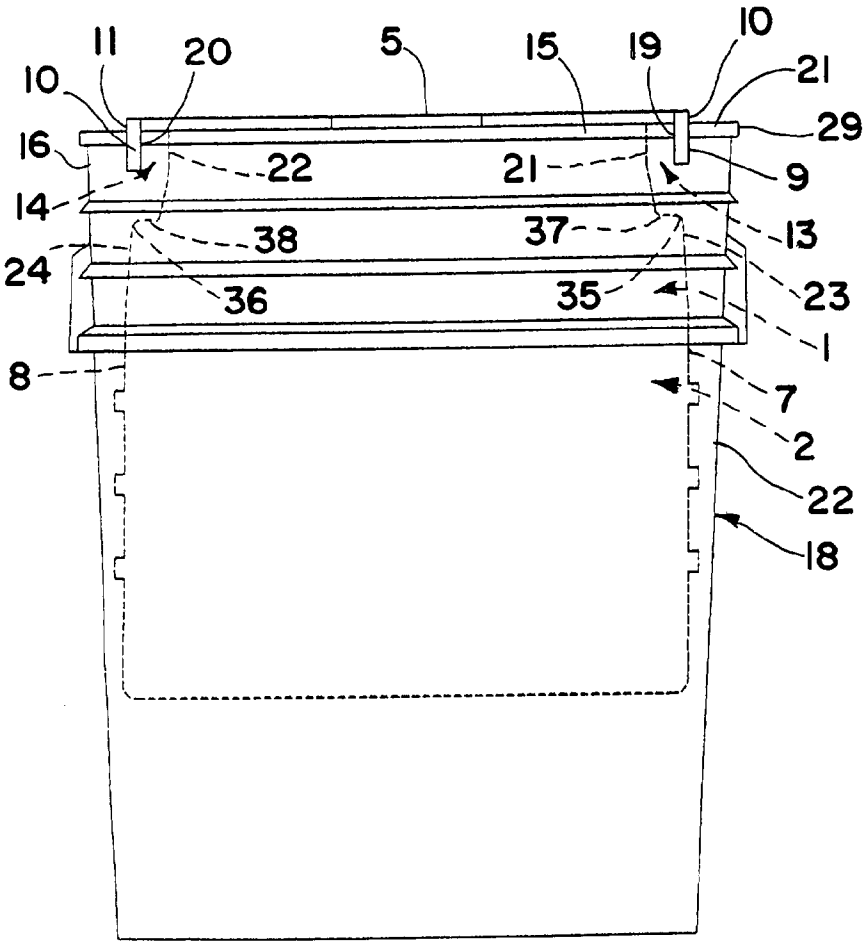
FIG. 6 is a schematic elevation view of the container of FIG. 5 showing the paint roller grid from the back.
Figure 7A:
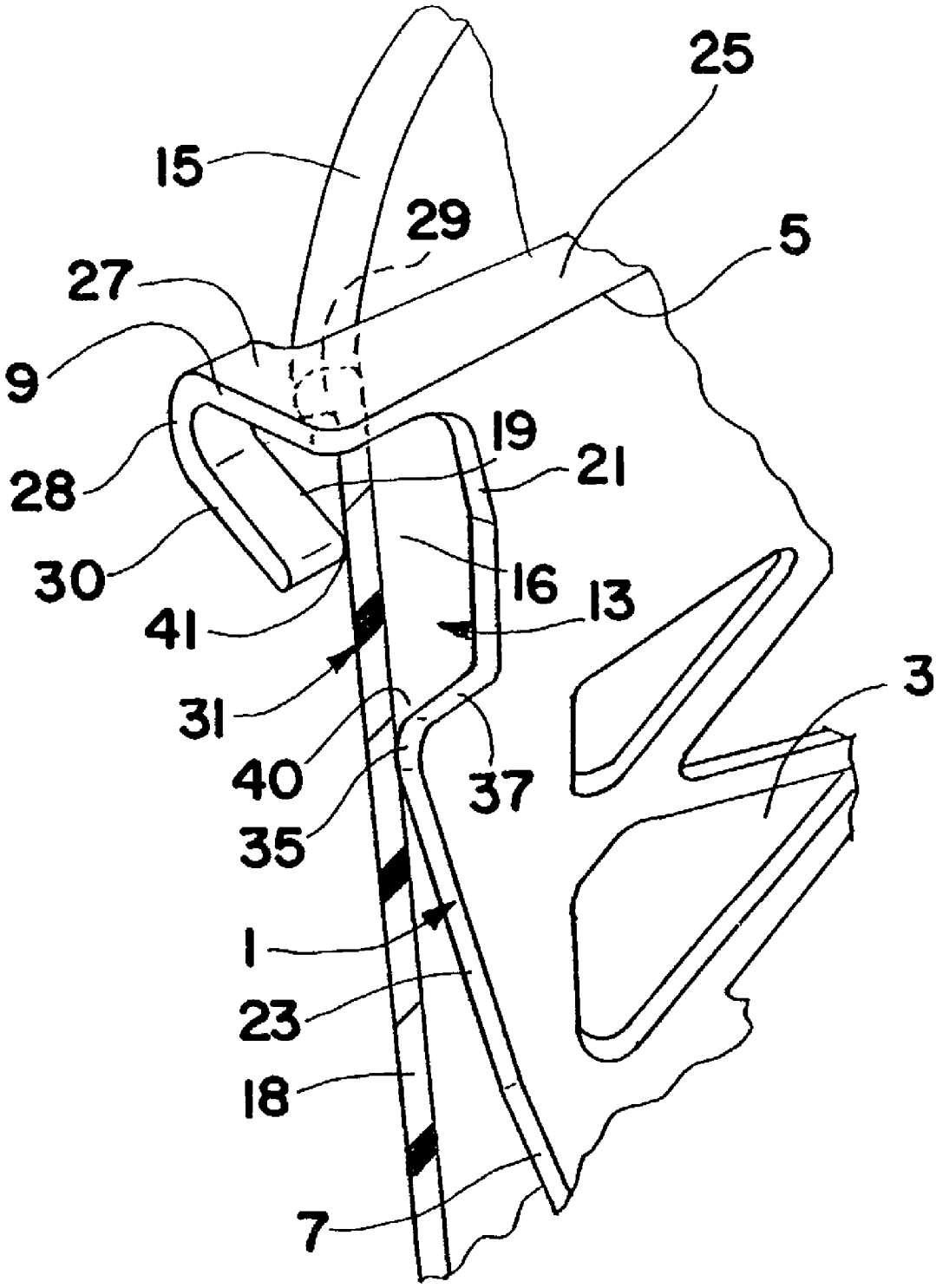
FIG. 7*a* is an enlarged schematic perspective view partially in section showing how the paint roller grid is secured to the upper rim of a standard five gallon container.

As can be seen in FIGS. 1, 4, 5, 7 and 7*a*, the grid hooks 9, 10 may be connected to the upper edge 5 of frame member 4 by integral web portions 25, 26 that extend laterally outwardly beyond opposite ends of the upper edge. Such hooks may have a rearwardly extending portion 27 adapted to engage the upper surface of the container rim 15, a downwardly extending forwardly facing curved portion 28 adapted to extend downwardly around an outturned lip 29 of the container rim, and a downwardly and forwardly angled free end portion 30 terminating in spaced relation from the back side of the paint roller grid to provide a gap 31 therebetween which is greater than the container wall thickness but less than the width of the outturned lip 29 of the container rim as schematically shown in FIGS. 7 and 7*a*. Therefore, when the paint roller grid 1 is inserted into the container 18 and the grid hooks 9, 10, which are flexible, are snapped over the outturned lip 29 of the container rim, the uppermost corners 35, 36 formed by the intersection of the upper portions 23, 24 of the side edges 7, 8 with the bottom edges 37, 38 of the notches 13, 14 will press against the inner surface 40 of the container side wall and the free end portions 30 of the hooks will extend beneath the container lip 29 and press against the outer surface 41 of the container side wall with the grid extending downwardly and forwardly at an angle within the container as schematically shown in FIG. 7*a* to resist lifting of the grid hooks off the container rim during rolling of a paint roller cover on the grid wiping surface 2.

Most paint roller covers have a width of nine inches or less. Accordingly, the paint roller grid 1 of the present invention may have a maximum width for example of approximately ten inches for ease of placement of the grid in a standard five gallon container with portions of the container rim and upper side wall received in the notches 13, 14 at the upper ends of the side edges of the frame member in the manner previously described.

Figure 8:
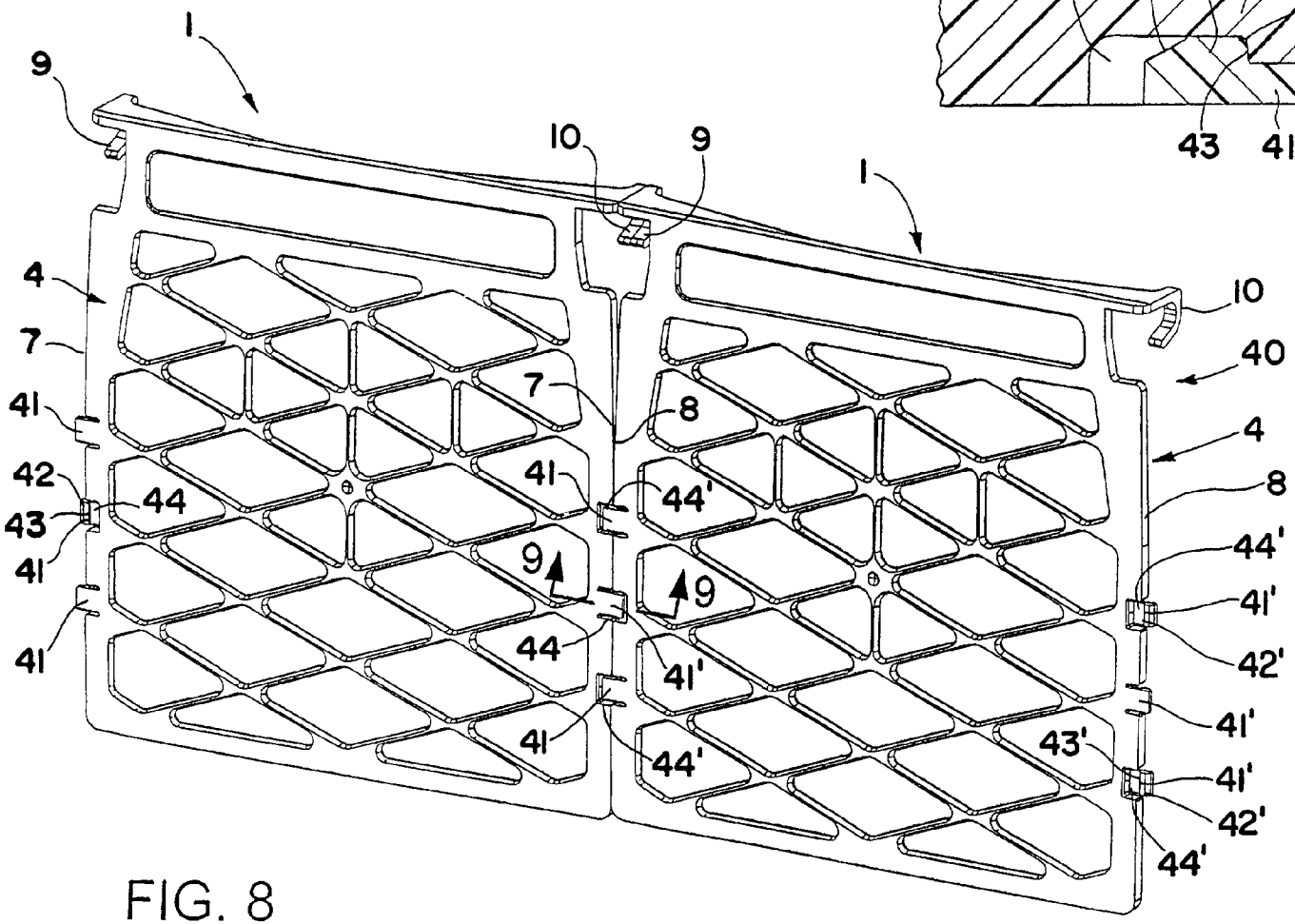
FIG. 8 is a perspective view showing two of the paint roller grids of FIG. 1 connected together along connectable side edges to form a wider paint roller grid assembly.

Other paint roller covers having a width greater than nine inches (for example eighteen inches) are sometimes used for applying paint to very large flat surface areas. Two or more grids 1 of the present invention may be adapted for use in dispersing paint more evenly over these larger width roller covers by detachably connecting two or more such grids together along their respective side edges to form a paint roller grid assembly 40 comprising two or more such grids 1 as schematically shown in FIG. 8. To that end, the opposite side edges 7, 8 of each paint roller grid 1 may be provided with a plurality of spaced apart laterally outwardly protruding tabs 41, 41' each having enlarged outer end portions 42, 42' that are adapted to overlap the enlarged outer end portions of the tabs along the respective side edge of another such grid for connecting two or more such grids together along their respective side edges.

In the embodiment disclosed herein, three such tabs 41, 41' are provided along both side edges 7, 8 of each grid in lateral alignment with each other. Also, the enlarged outer end portions 42 of the two end tabs 41 along one of the side edges 7 extend rearwardly from the two end tabs and the enlarged outer end portion 42 of the middle tab 41 along the one side edge 7 extends forwardly from the middle tab, whereas the enlarged outer end portions 42' of the corresponding two end tabs 41' along the other side edge 8 extend forwardly from the two end tabs and the enlarged outer end portion 42' of the corresponding middle tab 41' along the other side edge extends rearwardly from the middle tab. However, it will be appreciated that more than three laterally aligned tabs may be provided along each side edge of the grids 1 if desired. Also, the enlarged outer end portions 42, 42' of the tabs 41, 41' along each side edge desirably alternately face in opposite directions.

Figure 9:
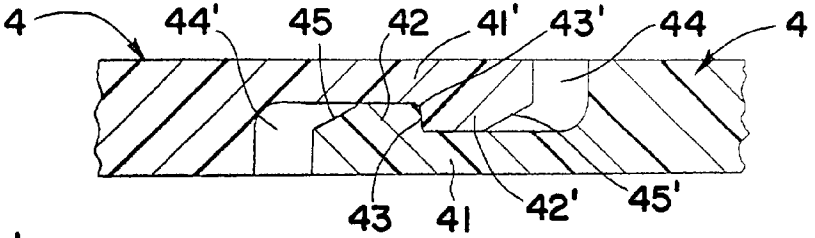
FIG. 9 is an enlarged transverse section through two of overlapping tabs on the connectable side edges of the two paint roller grids of FIG. 8 that connect the paint roller grids together along the respective side edges, taken along the plane of the line 9—9 thereof.

Each of the enlarged outer end portions 42, 42' of the tabs 41, 41' have laterally inwardly facing shoulders 43, 43' sized to engage the laterally inwardly facing shoulders of the respective tabs of another such grid for connecting two such grids together along their adjacent side edges as schematically shown in FIGS. 8 and 9. Also, each of the side edges 7, 8 desirably have recesses 44, 44' laterally inwardly of the enlarged outer end portions of the respective tabs that are adapted to receive the enlarged outer end portions of the corresponding tabs of another such grid when two or more such grids are connected together along the respective side edges as further schematically shown in FIGS. 8 and 9. To aid in sliding of the enlarged outer end portions of the tabs into overlapping engagement with each other, cam surfaces 45, 45' may be provided on the laterally outermost ends of the enlarged outer end portions as further schematically shown in FIG. 9.

Figure 11:
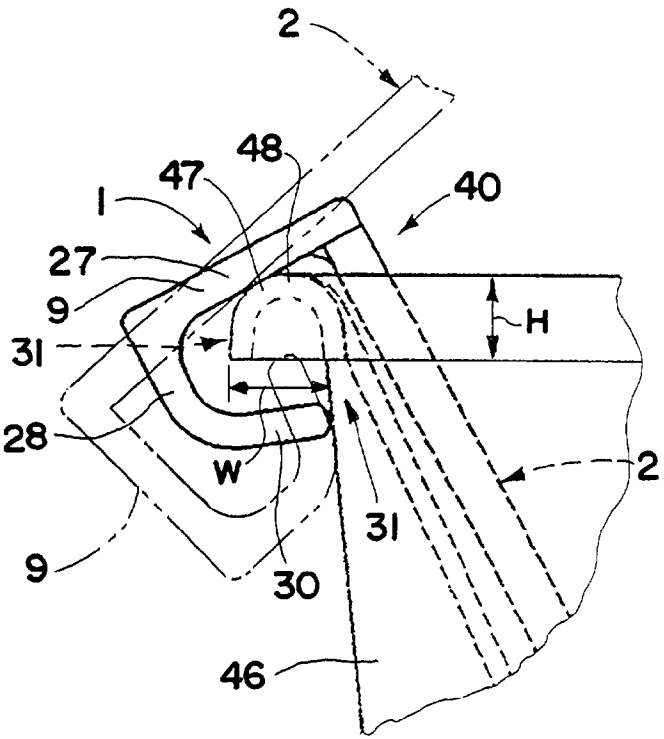
FIG. 11 is an enlarged schematic side elevation view of an outturned lip at the upper edge of the container of FIG. 10 and one of the paint roller grid hooks shown in solid lines hooked around the container lip with the grid assembly extending downwardly and forwardly into the container at an angle and also shown in phantom lines with the grid assembly extending upwardly at an angle relative to the container rim allowing the grid hook to engage and disengage the container lip for connecting and disconnecting the grid assembly from the container.
Figure 10:
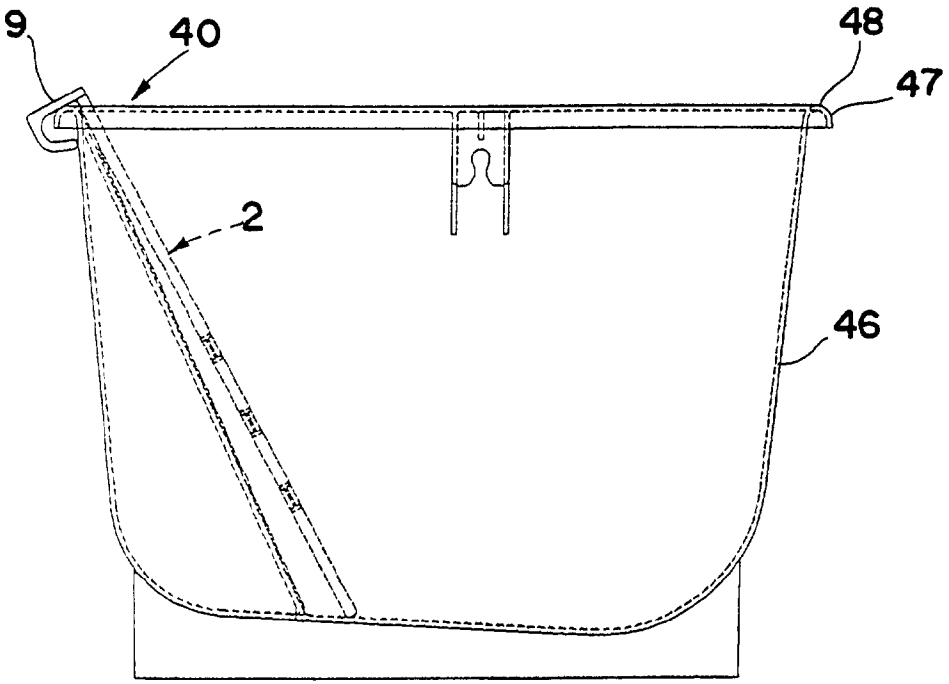
FIG. 10 is a schematic side elevation view of a wider container showing the paint roller grid assembly of FIG. 8 from one side extending downwardly and forwardly into the container at an angle.
Figure 12:
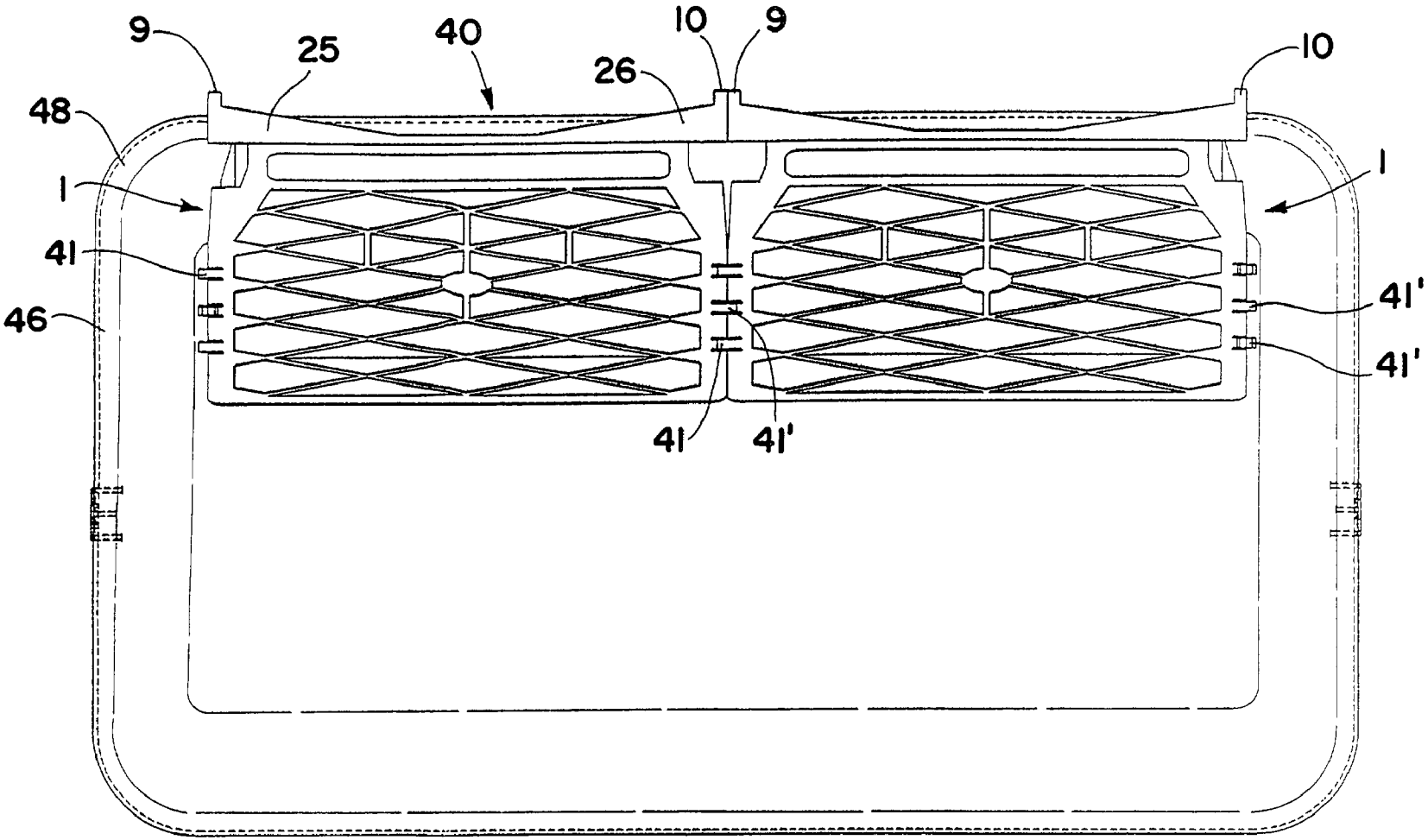
FIG. 12 is a schematic top plan view of the container of FIG. 10 showing the paint roller grid assembly of FIG. 8 from the front extending downwardly and forwardly into the container at an angle.

Such a grid assembly 40 may be mounted within a wider paint container 46 having a width at least somewhat greater than the overall width of the paint roller grid assembly 40 and a height somewhat less than the height of the grid assembly so that when the hooks 9, 10 of the grid assembly are attached to the upper rim of the container, the grid assembly will extend downwardly and forwardly into the container at an angle as schematically shown in FIGS. 10–12.

To provide a positive lock between the hooks 9, 10 along the upper edge 5 of each of the grids 1 and an outwardly and downwardly turned lip 47 along the upper rim 48 of the paint container 46 shown in FIGS. 10–12 during wiping of a paint roller cover along the grid wiping surfaces 2, the gap 31 between the free end portions 30 of the hooks 9, 10 and the back side of the respective grids may be greater than the height H of the lip 47 but less than the width W of the lip as schematically shown in FIG. 11. This allows the lip 47 to pass through the gap 31 when the grids are angled upwardly relative to the container rim 48 as schematically shown in phantom lines in FIG. 11. When in this position, if the grids are then rotated downwardly about the container lip into the container as schematically shown in solid lines in FIG. 11, the hooks will be prevented from being disengaged from the container lip unless and until the grids are once again rotated back to the upwardly angled position shown in phantom lines in FIG. 11.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein exemplary embodiments of the invention. In addition, while a particular feature of the invention may have been disclosed with respect to only one embodiment, such features may be combined with one or more other features of other embodiments as may be desired and advantageous for any given or particular application.

What is claimed is:

1. A plurality of paint roller grids, each of said grids comprising a wiping surface adapted to be supported in a container for wiping a roller cover against the wiping surface, a frame member surrounding said wiping surface, said frame member having upper and lower edges and opposite side edges, and a plurality of spaced apart laterally outwardly protruding tabs along at least one of said side edges engageable with the laterally outwardly protruding tabs along an adjacent side edge of another such grid for connecting two such grids together along respective side edges to form a paint roller grid assembly comprising two such grids, said tabs having enlarged outer end portions that are adapted to overlap the enlarged outer end portions of the tabs of another such grid for connecting two such grids together along their respective side edges, the enlarged outer end portions of said tabs having laterally inwardly facing shoulders sized to engage the laterally inwardly facing shoulders of the respective tabs of another such grid for connecting two such grids together along their respective side edges.

2. The paint roller grids of claim 1 further comprising a pair of laterally spaced apart hooks connected to said upper edge of said frame member of each of said grids for releasably attaching said grids to an upper rim of the container.

3. The paint roller grids of claim 2 wherein each of said hooks has a rearwardly extending upper portion adapted to abut an upper surface of the container rim, a downwardly extending forwardly facing curved portion sized to extend around a downturned lip of the container rim, and a downwardly and forwardly sloping free end portion terminating in spaced relation from a back side of each of said grids to provide a gap therebetween having a width which is greater than the height of the downturned lip to allow the downturned lip to pass through the gap when the grids are angled upwardly relative to the container rim and which is less than the width of the downturned lip to prevent the hooks from being disengaged from the downturned lip when the grids are rotated downwardly about the container rim into the container.

4. The paint roller grids of claim 2 wherein said hooks are spaced laterally outwardly from opposite ends of said upper edge of said frame member to provide spaces therebetween for receipt of portions of the upper rim and upper side wall of the container in such spaces.

5. The paint roller grids of claim 4 wherein each of said hooks has a rearwardly extending upper portion adapted to abut an upper surface of the container rim, a downwardly extending forwardly facing curved portion sized to extend around a downturned lip of the container rim, and a downwardly and forwardly sloping free end portion sized to overlap a bottom edge of the downturned lip to resist lifting of the hooks off the container rim.

6. The paint roller grids of claim 2 wherein said hooks have outermost side edges that are in substantial vertical alignment with said opposite side edges of said frame member except at upper ends of said side edges which have notches therein for receiving portions of the container rim and upper side wall of the container.

7. The paint roller grids of claim 6 wherein portions of said side edges of said frame member immediately below said notches have a slight inward taper toward said notches.

8. A paint roller grid assembly comprising at least two paint roller grids, each of said grids having a wiping surface for wiping a paint roller cover against the wiping surface, a frame member surrounding said wiping surface, said frame member having upper and lower edges and opposite side edges, and a plurality of spaced apart tabs along respective side edges of said grids, said tabs along said respective side edges of said grids having enlarged outer end portions in overlapping engagement with each other for connecting said grids together along their respective side edges, the enlarged outer end portions of said tabs along said respective side edges of said grids having laterally inwardly facing shoulders in overlapping engagement with each other, and said respective side edges having recesses laterally inwardly of the enlarged outer end portions of the respective tabs in which the enlarged outer end portions of the corresponding tabs of the other grid are received.

9. The paint roller grid assembly of claim 8 wherein there are three said tabs along each of said side edges of said grids, the enlarged outer end portions of two of said tabs along one of said side edges extending forwardly from said two tabs and the enlarged outer end portion of the third tab along said one side edge extending rearwardly from said third tab, and the enlarged outer end portions of the corresponding two tabs along the other side edge extending rearwardly from said two tabs, and the enlarged outer end portion of the corresponding third tab along said other side edge extending forwardly from said third tab.

10. A paint roller grid comprising a wiping surface adapted to be supported in a container for wiping a paint roller cover against the wiping surface, a frame member surrounding said wiping surface, said frame member having upper and lower edges and opposite side edges, and a pair of laterally spaced apart hooks connected to said upper edge of said frame member for releasably connecting said grid to an upper rim of the container, said hooks being spaced laterally outwardly from opposite ends of said upper edge of said frame member to provide spaces therebetween for receipt of portions of the upper rim and upper side wall of the container in said spaces, said hooks having outermost side edges that are in substantial vertical alignment with said opposite side edges of said frame member except at upper ends of said side edges which have notches forming said spaces for receiving portions of the upper rim and upper side wall of the container.

11. The paint roller grid of claim 10 in combination with the container, wherein each of said hooks has a rearwardly extending upper portion adapted to abut an upper surface of the container rim, a downwardly extending forwardly facing curved portion sized to extend around a downturned lip of the container rim, and a downwardly and forwardly sloping free end portion terminating in spaced relation from a back side of said grid to provide a gap therebetween having a width which is greater than the height of the downturned lip to allow the downturned lip to pass through the gap when the grid is angled upwardly relative to the container rim and which is less than the width of the downturned lip to prevent the hooks from being disengaged from the downturned lip when the grid is rotated downwardly about the container rim into the container.

12. The paint roller grid of claim 10 wherein portions of said side edges of said frame member immediately below said notches have a slight inward taper toward said notches.

13. The paint roller grid of claim 10 wherein said hooks have rearwardly extending upper portions adapted to abut an upper surface of the container rim, downwardly extending forwardly facing curved portions sized to extend around a downturned lip of the container rim, and downwardly and forwardly sloping free end portions sized to overlap a bottom edge of the downturned lip to resist lifting of the hooks off the container rim.

14. A plurality of paint roller grids, each of said grids comprising a wiping surface adapted to be supported in a container for wiping a roller cover against the wiping surface, a frame member surrounding said wiping surface, said frame member having upper and lower edges and opposite side edges, and at least three spaced apart laterally outwardly protruding tabs along each of said side edges in lateral alignment with each other, said tabs having enlarged outer end portions that are adapted to overlap the enlarged outer end portions of the tabs of another such grid for connecting two such grids together along respective side edges to form a paint roller grid assembly comprising two such grids, the enlarged outer end portions of two of said tabs along one of said side edges extending forwardly from said two tabs and the enlarged outer end portion of the third tab along said one side edge extending rearwardly from said third tab, and the enlarged outer end portions of the corresponding two tabs along the other side edge extending rearwardly from said two tabs and the enlarged outer end portion of the corresponding third tab along said other side edge extending forwardly from said third tab, the enlarged outer end portions of said tabs along each of said side edges alternately extending forwardly and rearwardly from the respective tabs.

15. A plurality of paint roller grids, each of said grids comprising a wiping surface adapted to be supported in a container for wiping a roller cover against the wiping surface, a frame member surrounding said wiping surface, said frame member having upper and lower edges and opposite side edges, and a plurality of spaced apart laterally outwardly protruding tabs along at least one of said side edges engageable with the laterally outwardly protruding tabs along an adjacent side edge of another such grid for connecting two such grids together along respective side edges to form a paint roller grid assembly comprising two such grids, said tabs having enlarged outer end portions that are adapted to overlap the enlarged outer end portions of the tabs of another such grid for connecting two such grids together along their respective side edges, said one side edge having recesses laterally inwardly of the enlarged outer end portions of the respective tabs that are adapted to receive the enlarged outer end portions of the corresponding tabs of another such grid when two such grids are connected together along their respective side edges.

16. A plurality of paint roller grids, each of said grids comprising a wiping surface adapted to be supported in a container for wiping a roller cover against the wiping surface, a frame member surrounding said wiping surface, said frame member having upper and lower edges and opposite side edges, and a plurality of spaced apart laterally outwardly protruding tabs along at least one of said side edges engageable with the laterally outwardly protruding tabs along an adjacent side edge of another such grid for connecting two such grids together along respective side edges to form a paint roller grid assembly comprising two such grids, said tabs having enlarged outer end portions that are adapted to overlap the enlarged outer end portions of the tabs of another such grid for connecting two such grids together along their respective side edges, the enlarged outer end portions of said tabs having laterally outwardly facing cam surfaces to aid in sliding of the enlarged outer end portions of the respective tabs of two such grids into overlapping engagement with each other.

* * * * *